US011181842B2

(12) United States Patent
Kobayashi

(10) Patent No.: US 11,181,842 B2
(45) Date of Patent: Nov. 23, 2021

(54) TWO-COMPONENT DEVELOPER

(71) Applicant: KYOCERA Document Solutions Inc., Osaka (JP)

(72) Inventor: Ryota Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/781,454

(22) Filed: Feb. 4, 2020

(65) Prior Publication Data

US 2020/0257215 A1 Aug. 13, 2020

(30) Foreign Application Priority Data

Feb. 7, 2019 (JP) ..... JP2019-020694

(51) Int. Cl.
*G03G 9/08* (2006.01)
*G03G 9/097* (2006.01)
*G03G 9/107* (2006.01)

(52) U.S. Cl.
CPC ..... *G03G 9/09708* (2013.01); *G03G 9/0821* (2013.01); *G03G 9/09716* (2013.01); *G03G 9/09725* (2013.01); *G03G 9/107* (2013.01)

(58) Field of Classification Search
None
See application file for complete search history.

(56) References Cited

U.S. PATENT DOCUMENTS

| | | | | |
|---|---|---|---|---|
| 8,394,565 | B2 | 3/2013 | Sensui | |
| 2004/0137349 | A1* | 7/2004 | Horikoshi | G03G 9/09 430/108.6 |
| 2010/0173240 | A1 | 7/2010 | Sensui | |
| 2018/0246432 | A1* | 8/2018 | Nishikawa | G03G 9/0819 |
| 2019/0033737 | A1* | 1/2019 | Iguchi | G03G 9/09708 |
| 2019/0384194 | A1* | 12/2019 | Yoshiba | G03G 9/08708 |

FOREIGN PATENT DOCUMENTS

WO 2007/114502 A1 10/2007

* cited by examiner

*Primary Examiner* — Mark A Chapman
(74) *Attorney, Agent, or Firm* — Studebaker & Brackett PC

(57) ABSTRACT

A two-component developer includes a toner including toner particles and a carrier including carrier particles. The toner particles each include a toner mother particle and an external additive attached to a surface of the toner mother particle. The external additive includes external additive particles. The external additive particles each include a base containing strontium titanate, a conductive layer covering the base, and a surface treatment layer either directly or indirectly covering the conductive layer. The surface treated layer contains a component derived from a hydrophobizing agent.

5 Claims, 2 Drawing Sheets

TWO-COMPONENT DEVELOPER

INCORPORATION BY REFERENCE

The present application claims priority under 35 U.S.C. § 119 to Japanese Patent Application No. 2019-20694, filed on Feb. 7, 2019. The contents of this application are incorporated herein by reference in their entirety.

BACKGROUND

The present disclosure relates to a two-component developer.

For electrophotographic image formation, a two-component developer is used that includes a toner including toner particles and a carrier including carrier particles. The toner particles each include for example a toner mother particle and an external additive attached to a surface of the toner mother particle. Abrasive particles may be used as the external additive included in the toner particles for the purpose to abrade a surface of a photosensitive member (for example, an amorphous silicon photosensitive member). An example of external additives such as above is conductive fine particles subjected to hydrophobizing treatment.

SUMMARY

A two-component developer according to an aspect of the present disclosure includes a toner including toner particles and a carrier including carrier particles. The toner particles each include a toner mother particle and an external additive attached to a surface of the toner mother particle. The external additive includes external additive particles. The external additive particles each include a base containing strontium titanate, a conductive layer covering the base, and a surface treatment layer either directly or indirectly covering the conductive layer. The surface treatment layer contains a component derived from a hydrophobizing agent.

DETAILED DESCRIPTION

Figure 1:
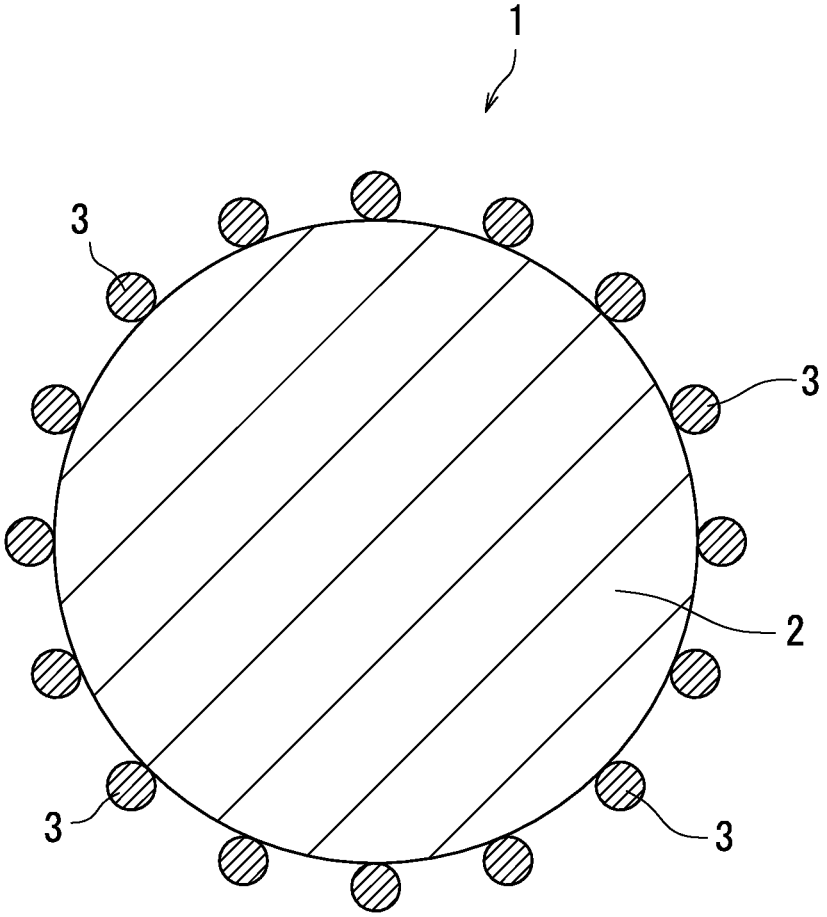
FIG. 1 is a schematic cross-sectional view of an example of a toner particle included in a two-component developer according to the present disclosure.

The following describes a preferable embodiment of the present disclosure. Note that a toner herein refers to a collection (for example, a powder) of toner particles. A carrier herein refers to a collection (for example, a powder) of carrier particles. An external additive herein refers to a collection (for example, a powder) of external additive particles. Evaluation results (values indicating for example shapes or properties) for a powder (specific examples include a powder of toner particles and a powder of external additive particles) each are a number average of values measured for an appropriate number of particles selected from the powder unless otherwise stated.

Values for volume median diameter ($D_{50}$) of a powder were measured based on the Coulter principle (electrical sensing zone technique) using "Coulter Counter Multisizer 3" produced by Beckman Coulter, Inc. unless otherwise stated.

Unless otherwise stated, a number average primary particle diameter of a powder refers to a number average value of equivalent circle diameters of primary particles of the powder (Heywood diameters: diameters of circles having the same areas as projected areas of the respective primary particles) measured using a scanning electron microscope. The number average primary particle diameter of a powder indicates the number average value of equivalent circle diameters of 100 primary particles, for example. Unless otherwise stated, the number average primary particle diameter of particles indicates a number average primary particle diameter of the particles of a powder.

Chargeability refers to chargeability in triboelectric charging unless otherwise stated. Positive chargeability (or negative chargeability) in triboelectric charging can be determined using a known triboelectric series. For example, a measurement target (for example, a toner) and a standard carrier (carrier for negatively chargeable toner use: N-01, carrier for positively chargeable toner use: P-01) provided by The Imaging Society of Japan are mixed and stirred together to frictionally charge the measurement target. An amount of charge of a measurement target is measured before and after triboelectric charging for example using a charge measuring device (Q/m meter). A larger change in amount of charge between before and after triboelectric charging indicates stronger chargeability of the measurement target.

A "main component" of a material refers to a component included in the material the most in terms of mass unless otherwise stated.

A strength of hydrophobicity (or a strength of hydrophilicity) can be expressed for example by a contact angle of a water drop (water wettability). The larger the contact angle of a water drop is, the stronger the hydrophobicity is.

In the following description, the term "-based" may be appended to the name of a chemical compound to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

<Two-Component Developer>

A two-component developer according to an embodiment of the present disclosure includes a toner including toner particles and a carrier including carrier particles. The toner particles each include a toner mother particle and an external additive attached to a surface of the toner mother particle. The external additive includes external additive particles (also referred to below as external additive particles (A)). The external additive particles (A) each include a base containing strontium titanate, a conductive layer covering the base, and a surface treatment layer either directly or indirectly covering the conductive layer. The surface treatment layer contains a component derived from a hydrophobizing agent.

The two-component developer according to the present disclosure can be used for image formation using for example an electrophotographic apparatus (image forming apparatus). As a result of stirring of the carrier and the toner of the two-component developer according to the present disclosure in a development device, the toner is charged.

With use of a known two-component developer, electric discharge caused by toner separation is caused in removal of residual toner (toner not transferred and remaining on a photosensitive member) by a cleaning blade or the like, thereby tending to form a pinhole as a defect in the photosensitive member. Such a phenomenon may be referred to below simply as a pinhole or a photosensitive member pinhole. With use of the two-component developer according to the present disclosure having the above features, a photosensitive member pinhole which is caused due to the presence of residual toner less occurs and excellent image density stability and excellent anti-fogging property can be achieved. The reasons thereof are described below. The external additive particles (A) included in the two-component developer according to the present disclosure each include a conductive layer, and therefore, excessive charge accumulation in the toner particles is suppressed. Therefore, the two-component developer of the present disclosure less causes occurrence of a photosensitive member pinhole which is caused due to presence of residual toner. Furthermore, the surface treatment layers formed from a hydrophobizing agent cover either directly or indirectly the conductive layers of the respective external additive particles (A). The surface treatment layers inhibit peeling off of the conductive layers and increase charge stability of the toner in a high-temperature and high-humidity environment. Furthermore, the bases containing strontium titanate tend to have chargeability approximate to respective chargeabilities of the conductive layers and the surface treatment layers in the external additive particles (A). Therefore, chargeability of the toner is less influenced even in a situation in which the surface treatment layers and the conductive layers peel off with use of the external additive particles (A). For the above reasons, chargeability of the toner less varies, and therefore, excellent image density stability and excellent anti-fogging property are thought to be achieved with use of the two-component developer according to the present disclosure.

The two-component developer can be obtained for example by mixing and stirring the carrier and the toner using a mixer (specific examples include a ball mill and a ROCKING MIXER (registered Japanese trademark)). An amount of the toner is preferably at least 1 part by mass and no greater than 20 parts by mass relative to 100 parts by mass of the carrier, and more preferably at least 3 parts by mass and no greater than 15 parts by mass.

The following further describes the two-component developer in detail. Note that one of components described below may be used independently or two or more of the components described below may be used in combination.

[Toner Particles]

FIG. 1 illustrates an example of a toner particle 1 included in the toner. The toner particle 1 illustrated in FIG. 1 includes a toner mother particle 2 and an external additive attached to a surface of the toner mother particle 2. The external additive includes the external additive particles (A) 3.

However, the toner particles included in the two-component developer according to the present disclosure may differ in structure from the toner particle 1 illustrated in FIG. 1. Specifically, the toner particles may include only the external additive particles (A) as the external additive but may further include external additive particles other than the external additive particles (A) (also referred to below as additional external additive particles). Furthermore, each of the external additive particles (A) has a rectangular shape (for example, a square shape) in cross section. The toner particles may each be a toner particle including a shell layer (also referred to below as a capsule toner particle). The capsule toner particle includes a toner mother particle for example including a toner core containing a binder resin and a shell layer covering a surface of the toner core. The toner particles included in the two-component developer according to the present disclosure have been described so far with reference to FIG. 1.

(External Additive Particles (A))

The external additive particles (A) each include a base containing strontium titanate, a conductive layer covering the base, and a surface treatment layer either directly or indirectly covering the conductive layer. The surface treatment layer contains a component derived from a hydrophobizing agent. The following describes structure of the external additive particles (A) using two examples with reference to the drawings.

Figure 2:
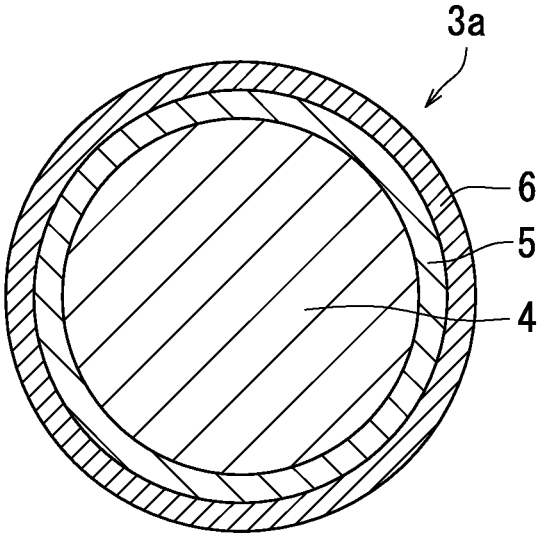
FIG. 2 is a schematic cross-sectional view of an example of an external additive particle in FIG. 1.

FIG. 2 illustrates an external additive particle (A) 3*a* which is the first example of the external additive particles (A). The external additive particle (A) 3*a* includes a base 4 containing strontium titanate, a conductive layer 5 covering the base 4, and a surface treatment layer 6 directly covering the conductive layer 5. The external additive particles (A) 3*a* can be prepared at low cost as compared to external additive particles (A) 3*b* of the later-described second example of the external additive particles (A).

Figure 3:
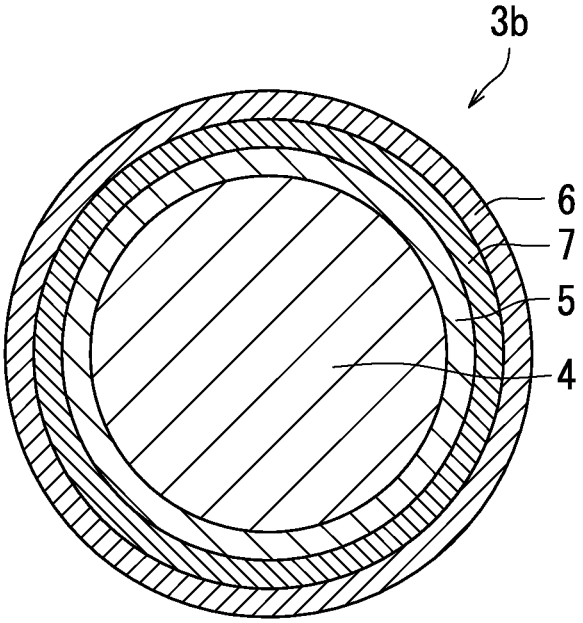
FIG. 3 is a schematic cross-sectional view of an example of the external additive particle in FIG. 1.

FIG. 3 illustrates the external additive particle (A) 3*b* which is the second example of the external additive particles (A). The external additive particle (A) 3*b* includes a base 4 containing strontium titanate, a conductive layer 5 covering the base 4, a surface treatment layer 6 indirectly covering the conductive layer 5, and a protective layer 7 disposed between the conductive layer 5 and the surface treatment layer 6.

The external additive particles (A) 3*b* is different from the external additive particles (A) 3*a* in additional inclusion of the protective layer 7 and indirect covering of the conductive layer 5 by the surface treatment layer 6 with the protective layer 7 therebetween. The external additive particles (A) 3*b* can effectively inhibit peeling off of the conductive layers 5 due to the presence of the protective layers 7 as compared to the external additive particles (A) 3*a*. As such, with use of the two-component developer including the external additive particles (A) 3*b* as compared to the two-component developer including the external additive particles (A) 3*a*, a photosensitive member pinhole which is caused due to presence of residual toner occurs less and excellent image density stability and excellent anti-fogging property can be achieved.

Two examples of the external additive particles (A) have been described so far with reference to the drawings. However, the structure of the external additive particles (A) is not limited to those illustrated in FIGS. 2 and 3. Specifically, the external additive particles (A) may further include an additional layer in addition to the conductive layer, the protective layer, and the surface treatment layer. In addition, the conductive layer may indirectly cover the base. The conductive layer, the protective laver, and the surface treatment layer are each preferably a single layer, but any of the layers may be a multilayer.

The external additive particles (A) preferably have a number average primary particle diameter of at least 60 nm and no greater than 300 nm, and more preferably at least 75 nm and no greater than 150 nm. As a result of the external additive particles (A) having a number average primary particle diameter of at least 60 nm and no greater than 300 nm, separation of the external additive particles (A) from the toner mother particles can be inhibited and filming resistance of the toner can be increased.

The external additive particles (A) are contained in the toner particles preferably in an amount of at least 0.1 parts by mass and no greater than 5.0 parts by mass relative to 100 parts by mass of the toner mother particles, and more preferably in an amount of at least 0.5 parts by mass and no greater than 2.0 parts by mass. As a result of the external additive particles (A) being contained in an amount of at least 0.1 parts by mass and no greater than 5.0 parts by mass, occurrence of a photosensitive member pinhole caused due to presence of residual toner can be further effectively inhibited and image density stability and anti-fogging property can be further increased.

(Bases)

The base contains strontium titanate. The bases contain strontium titanate preferably in an amount of at least 80% by mass, more preferably in an amount of at least 95% by mass, and further preferably in an amount of 100% by mass.

No particular limitations are placed on a base preparation method, and an example thereof is a method in which strontium carbonate and titanium oxide or metatitanic acid are mixed and baked (a baking method).

Alternatively, a heating reaction under atmospheric pressure may be employed as the base preparation method. As compared to the baking method, the heating reaction under atmospheric pressure tends to produce bases having a small number average primary particle diameter. Examples of the heating reaction under atmospheric pressure include: a method A in which a reaction between a strontium compound and a hydrolysate of a titanium compound is caused in a strong alkaline aqueous solution; a method B in which a wet reaction between a strontium compound and a hydrolysate of a titanium compound is caused in presence of hydrogen peroxide; a method C in which a strontium compound in a solution state and a titanium compound in a solution state or a slurry state are mixed while being heated; and a method D in which a strontium source and a hydrolysate of a titanium compound peptized with a mineral acid are mixed and an alkaline aqueous solution is added to the resultant mixture while the mixture is heated at a temperature of 50° C. or higher.

(Conductive Layers)

The conductive layers preferably contain an oxide having conductivity, and more preferably contain a metal oxide having conductivity. Examples of the metal oxide having conductivity include metal oxides containing tin oxides (for example, antimony-doped tin oxide (ATO), indium tin oxide (ITO), and fluorine-doped tin oxide (FTO)) and metal oxides containing zinc oxides (for example, aluminum-doped zinc oxide (AZO) and gallium-doped zinc oxide (GZO)). The conductive layers preferably contain antimony-doped tin oxide. An amount of an oxide having conductivity contained in the conductive layers is preferably at least 80% by mass, more preferably at least 95% by mass, and further preferably 100% by mass.

In a case where the conductive layers contain antimony-doped tin oxide, a ratio of a mass of tin oxide ($SnO_2$) (specifically, a mass of tin oxide ($SnO_2$) contained in the conductive layers) to a mass of the bases (mass of $SnO_2$/mass of bases) is preferably at least 0.55 and no greater than 1.90, and more preferably at least 0.75 and no greater than 1.20. Here, the ratio of the mass of tin oxide is a value roughly indicating a thickness 1.0 of the conductive layers in the respective external additive particles (A). As a result of the ratio of the mass of tin oxide being at least 0.55, sufficient conductivity can be imparted to the external additive particles (A) and a photosensitive member pinhole caused due to presence of residual toner can be further effectively inhibited. As a result of the ratio of the mass of tin oxide being no greater than 1.90, peeling off of the conductive layers from the bases can be inhibited.

In a case where the conductive layers contain antimony-doped tin oxide, a ratio of an amount of substance of antimony atoms to a total amount of substance of tin atoms and the antimony atoms in the conductive layers (amount of substance of antimony atoms)/(amount of substance of tin atoms+amount of substance of antimony atoms)) is preferably at least 0.09 and no greater than 0.29, and more preferably at least 0.15 and no greater than 0.25. Antimony-doped tin oxide tends to have particularly high conductivity when the above ratio is at least 0.09 and no greater than 0.29. As such, further high conductivity can be imparted to the external additive particles (A) through the above ratio being set to at least 0.09 and no greater than 0.29, thereby achieving further effective inhibition of a photosensitive member pinhole caused due to presence of residual toner.

The following describes a method for covering the bases with the conductive layers containing antimony-doped tin oxide. First, the bases are dispersed in a water-based solvent (for example, water). To the resultant suspension containing the bases, an alkaline aqueous solution (for example, an ammonia aqueous solution) and an acid aqueous solution obtained by dissolving stannic chloride pentahydrate ($SnCl_4.5H_2O$) and antimony trichloride ($SbCl_3$) in hydrochloric acid are added next. Through the above, coat layers are formed on surfaces of the respective bases. Thereafter, the bases having the coat layers formed thereon are baked (for example, at a heating temperature of 600° C. or higher and 800° C. or lower, for a heating time of 1 hour or longer and 4 hours or shorter), thereby obtaining the bases covered with the conductive layers containing antimony-doped tin oxide. In addition of each of the acid aqueous solution and the alkali aqueous solution, the pH and the temperature of the suspension are preferably kept in respective specific ranges (for example, a pH of at least 6.5 and no greater than 9.0 and a temperature of 60° C. or higher and 80° C. or lower).

(Protective Layers)

The protective layers inhibit peeling off of the conductive layers. The protective layers preferably contain a nitrogen-containing resin, aluminum hydroxide, or a component derived from a titanate coupling agent. That is, preferable protective layers are layers formed from a titanate coupling agent or layers containing a nitrogen-containing resin or aluminum hydroxide.

Examples of the titanate coupling agent include isopropyl triisostearoyl titanate, isopropyl tri(dioctylpyrophosphate) titanate, isopropyltri(N-aminoethyl-aminoethyl)titanate, tetraoctylbis(ditridecylphosphite)titanate, isopropyl trioctanoyl titanate, isopropyldimethacryl isostearoyl titanate, isopropyhridodecylbenzene sulfonyl titanate, isopropylisostearoyl diacrylic titanate, and isopropyl tri(dioctylphosphate)titanate. A preferable titanate coupling agent is isopropyl triisostearoyl titanate.

Examples of the nitrogen-containing resin include melamine resins, urea resins, polyamide resins, polyimide resins, polyamide-imide resins, aniline resins, guanamine resins, and polyurethane resins. A preferable nitrogen-containing resin is a urethane resin or a melamine resin.

A mass of the protective layers in the external additive particles (A) is preferably at least 5 parts by mass and no greater than 120 parts by mass relative to 100 parts by mass of the bases, and more preferably at least 10 parts by mass and no greater than 50 parts by mass. As a result of the mass of the protective layers being at least 5 parts by mass, peeling off of the conductive layers can be further effectively inhibited. As a result of the mass of the protective layers being no greater than 150 parts by mass, excessive charge accumulation of the toner particles can be further effectively inhibited.

Examples of a protective layer forming method include a first method and a second method. In the first method, a raw material component of the protective layers (for example, a titanate coupling agent, a nitrogen-containing resin, or a set of poly-aluminum chloride and sodium hydroxide) is dripped or sprayed into a solution containing the bases covered with the conductive layers under stirring and the resultant mixture is heated. In the second method, the bases covered with the conductive layers are added to a solution containing the raw material component of the protective layers under stifling and the resultant mixture is heated. Heating conditions in the first and second methods may be for example a heating temperature of 70° C. or higher and 150° C. or lower and a heating time of 30 minutes or longer and 5 hours or shorter.

(Surface Treatment Layers)

The surface treatment layers are layers formed from a hydrophobizing agent, and impart hydrophobicity to the external additive particles (A). Examples of the hydrophobizing agent include titanate coupling agents, silane coupling agents, silicone oils, fatty acids, and fatty acid metal salts. A preferable hydrophobizing agent is a titanate coupling agent, a silane coupling agent, or a silicone oil.

Examples of the titanate coupling agents include the same compounds as the titanate coupling agents listed as the examples for the protective layers. A preferable titanate coupling agent is isopropyl triisostearoyl titanate.

Examples of the silane coupling agents include alkylalkoxysilanes. The alkylalkoxysilanes each preferably have an alkyl group having a carbon number of at least 3 and no greater than 8.

Examples of alkylalkoxysilanes include propyltrimethoxysilanes (specific examples include n-propyltrimethoxysilane and isopropyltrimethoxysilane), propyltriethoxysilanes (specific examples include n-propyltriethoxysilane and isopropyltriethoxysilane), butyltrimethoxysilanes (specific examples include n-butytrimethoxysilane and isobutyltrimethoxysilane), butyltriethoxysilanes (specific examples include n-butyltriethoxysilane and isobutyltriethoxysilane), hexyltrimethoxysilanes (specific examples include n-hexyltrimethoxysilane), hexyltriethoxysilanes (specific examples include n-hexyltriethoxysilane), octyltrimethoxy silanes (specific examples include n-octyltrimethoxysilane), and octyltriethoxysilanes (specific examples include n-octyltriethoxysilane).

The silane coupling agent is preferably an alkylalkoxysilane, more preferably monoalkyltrialkoxysilane, and further preferably isobutyltriethoxysilane.

Examples of the silicone oils include straight silicone oils (specific examples include dimethyl silicone oil, methylphenyl silicone oil, and methylhydrogen silicone oil), reactive modified silicone oils (specific examples include amino-modified silicone oil, epoxy-modified silicone oil, carboxyl-modified silicone oil, mercapto-modified silicone oil, methacrylic acid-modified silicone oil, phenol-modified silicone oil, and alcohol-modified silicone oil), and non-reactive modified silicone oils (specific examples include alkyl-modified silicone oil, higher fatty acid-modified silicone oil, fluorine-modified silicone oil, polyether-modified silicone oil, and methylstyryl-modified silicone oil). The silicone oil is preferably a straight silicone oil, and more preferably a methylhydrogen silicone oil.

A mass of the surface treatment layers in the external additive particles (A) is preferably at least 5 parts by mass and no greater than 100 parts by mass relative to 100 parts by mass of the bases, and more preferably at least 10 parts by mass and no greater than 40 parts by mass. As a result of the mass of the surface treatment layers being at least 5 parts by mass and no greater than 100 parts by mass, appropriate hydrophobicity can be imparted to the toner particles.

Examples of a specific surface treatment method include a first method and a second method. In the first method, a hydrophobizing agent is dripped or splayed into a solution containing particles not having undergone surface treatment (that is, the bases covered with the conductive layers and the protective layers or the bases covered with the conductive layers) under stirring and the resultant mixture is heated. In the second method, particles not having undergone surface treatment are added to a solution of a hydrophobizing agent under stirring and the resultant mixture is heated. Heating conditions in the first and second methods may be for example a heating temperature of 70° C. or higher and 150° C. or lower and a heating time of 30 minutes or longer and 5 hours or shorter.

The following describes preferable layer structure of the protective layer and the surface treatment layer in each external additive particle (A). In a case where the surface treatment layers directly cover the conductive layers (that is, a case where the external additive particles (A) include no protective layers), the surface treatment layers preferably contain a silicone oil or a component derived from either a titanate coupling agent or a silane coupling agent.

In a case where the external additive particles (A) each include the protective layer disposed between the conductive layer and the surface treatment layer, the protective layers preferably contain a nitrogen-containing resin, aluminum hydroxide, or a component derived from a titanate coupling agent. The surface treatment layers preferably contain a silicone oil or a component derived from a silane coupling agent.

A layer containing a component derived from a titanate coupling agent (layer formed from a titanate coupling agent) exhibits functions as both the protective layer and the surface treatment layer. Further, the layer containing a component derived from a titanate coupling agent tends to exhibit a particularly excellent function as a protective layer.

(Additional External Additive Particles)

The additional external additive particles are preferably inorganic particles, more preferably silica particles or particles of a metal oxide (specific examples include alumina, titanium oxide, magnesium oxide, and zinc oxide), and further preferably silica particles or titanium oxide particles. However, resin particles or particles of an organic acid compound such as a fatty acid metal salt (for example, zinc stearate) may be also used as the additional external additive particles.

In terms of sufficient exhibition of their function while inhibiting separation from the toner mother particles, the additional external additive particles are contained in the toner particles preferably in an amount of at least 0.1 parts by mass and no greater than 15.0 parts by mass relative to 100 parts by mass of the toner mother particles, and more preferably in an amount of at least 1.0 parts by mass and no greater than 5.0 parts by mass.

(Toner Mother Particles)

No particular limitations are placed on the toner mother particles, and toner mother particles of any known toner can be sued. The toner mother particles contain for example a binder resin as a main component. The toner mother particles may further contain an internal additive (for example, at least one of a colorant, a releasing agent, a charge control agent, and a magnetic powder) as necessary. Examples of a toner mother particle production method include a pulverization method and an aggregation method, and the pulverization method is preferable.

In terms of favorable image formation, the toner mother particles preferably have a volume median diameter ($D_{50}$) of at least 4 μm and no greater than 9 μm.

(Binder Resin)

In terms of enabling provision of a toner excellent in low-temperature fixability, the toner mother particles preferably contain a thermoplastic resin as the binder resin, and more preferably contain a thermoplastic resin in an amount of at least 85% by mass relative to a total mass of the binder resin. Examples of the thermoplastic resin include styrene-based resins, acrylic acid ester-based resins, olefin-based resins (specific examples include polyethylene resins and polypropylene resins), vinyl resins (specific examples include vinyl chloride resins, polyvinyl alcohols, vinyl ether resins, and N-vinyl resins), polyester resins, polyamide resins, and urethane resins. Copolymers of these resins, that is, copolymers of these resins into which an arbitrary repeating unit is introduced (specific examples include styrene-acrylic acid ester-based resins and styrene-butadiene-based resins) can be used as the binder resin.

The binder resin is contained in the toner mother particles preferably in an amount of at least 60% by mass and no greater than 95% by mass, and more preferably in an amount of at least 75% by mass and no greater than 90% by mass.

(Colorant)

The toner mother particles may contain a colorant. The colorant can be a known pigment or dye that matches the color of the toner. The amount of the colorant is preferably at least 1 part by mass and no greater than 20 parts by mass relative to 100 parts by mass of the binder resin in terms of formation of high-quality images using the toner.

The toner mother particles may contain a black colorant. Carbon black can for example be used as a black colorant. Alternatively, a colorant can be used that has been adjusted to a black color using colorants such as a yellow colorant, a magenta colorant, and a cyan colorant.

The toner mother particles may contain a non-black colorant. Examples of the non-black colorant include yellow colorants, magenta colorants, and cyan colorants.

(Releasing Agent)

The toner mother particles may contain a releasing agent. The releasing agent is for example used in order to impart offset resistance to a toner. In terms of impartation of sufficient offset resistance to the toner, the amount of the releasing agent is preferably at least 1 part by mass and no greater than 20 parts by mass relative to 100 parts by mass of the binder resin.

(Charge Control Agent)

The toner mother particles may contain a charge control agent. The charge control agent is used for example for the purpose to provide a toner having further excellent charge stability or an excellent charge rise characteristic. The charge rise characteristic of a toner is an indicator as to whether the toner can be charged to a specific charge level in a short period of time. Cationic strength of the toner mother particles can be increased by containing a positively chargeable charge control agent in the toner mother particles.

(Shell Layers)

The shell layers are substantially formed from a resin. The shell layers may be substantially formed from a thermosetting resin or a thermoplastic resin, or may contain both a thermosetting resin and a thermoplastic resin. Both heat-resistant preservability and low-temperature fixability of the toner can be achieved for example by using low-melting toner cores and covering each toner core with a highly heat-resistant shell layer. An additive may be dispersed in the resin forming the shell layers. The shell layers may entirely cover the surfaces of the respective toner cores or partially cover the surfaces of the respective toner cores.

[Carrier]

The carrier includes carrier particles. No particular limitations are placed on the carrier, and a carrier in any known two-component developer can be used as the carrier. Examples of the carrier include a carrier including carrier cores and coat layers covering the respective carrier cores.

(Carrier Cores)

The carrier cores preferably contain a magnetic material. The carrier cores may be particles made from a magnetic material or particles including a binder resin and particles made from a magnetic material dispersed in the binder resin (also referred to below as resin carrier cores).

Examples of the magnetic material contained in the carrier cores include ferromagnetic metals (specific examples include iron, cobalt, nickel, and alloys containing at least one of these metals) and oxides of the ferromagnetic metals. Examples of the ferromagnetic metal oxides include ferrites and magnetite that is one type of spinel ferrite. Examples of the ferrites include Ba ferrite, Mn ferrite, Mn—Zn ferrite, Ni—Zn ferrite, Mn—Mg ferrite, Ca—Mg ferrite, Li ferrite, Cu—Zn ferrite, and Mn—Mg—Sr ferrite. Examples of a carrier core production method include a method involving pulverization and baking of a magnetic material. In carrier core production, saturation magnetization of the carrier can be adjusted by changing the amount of the magnetic material (particularly, a rate of a ferromagnetic material). Also in carrier core production, the number average circularity of the carrier cores can be adjusted by changing the baking temperature. Note that commercially available carrier cores may be used.

Particles made from a magnetic material, which are used as the carrier cores, may be ferrite particles, for example. The ferrite particles tend to have sufficient magnetism for image formation using a two-component developer. Ferrite particles produced by a typical production method tend not to be truly spherical and tend to have appropriate projections and recesses in surfaces thereof. In a case where the carrier cores are ferrite particles (ferrite cores), the surfaces of the ferrite cores preferably have an arithmetic mean roughness (specifically, an arithmetic mean Ra defined in Japanese Industrial Standards (JIS) B0601-2013) of at least 0.3 μm and no greater than 2.0 μm in terms of improving adhesion of the surfaces of the ferrite cores to the coat layers.

(Coat Layers)

The coat layers contain a coating resin. The coat layers preferably contain only a coating resin, but may additionally contain an organic filler or an inorganic filler dispersed in the coating resin.

[Production of Two-component Developer]

The two-component developer according to the present disclosure can be produced by a method involving: a process of obtaining the toner particles by attaching the external additive including the external additive particles (A) on the surfaces of the toner mother particles (an external addition process), and a process of mixing the carrier including the carrier particles and the toner including the toner particles (a mixing process). Examples of each process will be described below.

(External Addition Process)

In the present process, the external additive including the external additive particles (A) are attached to the surfaces of the toner mother particles to obtain the toner particles. No particular limitations are placed on a method for attaching the external additive to the surfaces of the toner mother particles. An example of the method is a method in which the toner mother particles and the external additive are mixed together using for example a mixer.

(Mixing Process)

In the present process, the carrier including the carrier particles and the toner including the toner particles are mixed together. An example of a method for mixing the carrier and the toner is a method using a mixer (specific examples include a ball mill and a ROCKING MIXER (registered Japanese trademark)).

EXAMPLES

The following provides more specific description of the present disclosure through use of Examples. However, the present disclosure is by no means limited to Examples.

Note that in a case where an amount of a given raw material is expressed by "X moles in terms of $TiO_2$ conversion", it indicates that a reaction of the raw material at a percentage yield of 100% can yield a product containing X mole(s) of $TiO_2$.

[Preparation of External Additive Particles]

External additive particles (A-1) to (A-29) and (a-1) to (a-7) were prepared by the following methods. The following first provides detailed description of a "conductive layer formation process", a "titanate coupling agent providing treatment", a "silane coupling agent providing treatment", a "silicone oil providing treatment", a "urethane resin covering treatment", a "melamine resin covering treatment", and an "aluminum hydroxide covering treatment".

In each of the above process and treatments, "raw material particles" refer to target particles for a corresponding one of the process and the treatments. A "pulverizer" refers to "JET MILL (registered Japanese trademark) MODEL I-2" produced by Nippon Pneumatic Mfg. Co., Ltd. A ceramic flat plate was used as a collision plate in the pulverizer. A "starring device" refers to a device that is a motor ("AS ONE TORNADE MOTOR 1-5472-04", available at AS ONE Corporation) equipped with a stirring impeller ("AS ONE STIRRING IMPELLER R-1345", product of AS ONE Corporation).

(Conductive Layer Formation Process)

With respect to each type of the external additive particles (A-1) to (A-29) and (a-1) to (a-7), 300 g of bases were dispersed in pure water using "HOMOMIXER MARK MODEL II 2.5" produced by PRIMIX Corporation, thereby preparing 2 liters of a suspension. The prepared suspension was heated to 70° C. Stannic chloride pentahydrate ($SnCl_4.5H_2O$) and antimony trichloride ($SbCl_3$) were dissolved in 750 milliliters of 2.4 N hydrochloric acid, which was prepared separately, to prepare an acid solution. In the preparation of the acid solution, stannic chloride pentahydrate and antimony trichloride were added in amounts shown in Table 1 below. Thereafter, a 5 N ammonia aqueous solution and the acid solution were dripped in parallel into the suspension prepared as above over 1 hour. In the parallel dripping, the suspension was kept at 70° C. and each dripping amount was adjusted so that the suspension is kept at a pH of 7 to 8. Thereafter, the suspension was filtered. Pure water was added to the residue, and filtration was performed again (a washing process). The washing process was repeated until the filtrate had an electrical conductivity of 50 μS/cm or lower. The residue after the washing was dried at 110° C. for 12 hours and then baked at 700° C. for 2 hours using an electric furnace. The resultant baked product was pulverized at a pulverization pressure of 0.6 MPa using the pulverizer. Thus, the bases each covered with a conductive layer were obtained.

(Titanate Coupling Agent Providing Treatment)

Into a mixer ("NANOPERSION PICCOLO", product of KAWATA MFG CO., LTD.), 300 g of the raw material particles and 24 g of a titanate coupling agent ("PLENACT (registered Japanese trademark) TTS", product of Ajinomoto Co., Inc., isopropyl triisostearoyl titanate) were loaded. Then, mixing was performed for 1 hour under conditions of a temperature of 80° C. and a rotational speed of 6,000 rpm. Thereafter, the resultant mixture was dried for 12 hours at a temperature of 110° C. The resultant mixture after the drying was pulverized at a pulverization pressure of 0.6 MPa using the pulverizer. Through the above, the raw material particles each covered with a layer containing a component derived from the titanate coupling agent were obtained.

(Silane Coupling Agent Providing Treatment)

The raw material particles (300 g), a silane coupling agent ("ISOBUTHYLTRIETHOXYSILANE", product of Tokyo Chemical Industry Co., Ltd., 26 g), and an ethanol aqueous solution (ethanol 90% by mass, 50 g) were mixed together. The resultant liquid mixture was loaded into a mixer ("NANOPERSION PICCOLO", product of KAWATA MFG. CO., LTD.) and mixed for 1 hour under conditions of a temperature of 80° C. and a rotational speed of 6,000 rpm. Thereafter, the resultant mixture was dried for 12 hours at a temperature of 110° C. The resultant mixture after the drying was pulverized at a pulverization pressure of 0.6 MPa using the pulverzer. Through the above, the raw material particles each covered with a layer containing a component derived from the silane coupling agent were obtained.

(Silicone Oil Providing Treatment)

Into a mixer ("T. K. HIVIS DISPER MIX MODEL HM-3D-5", product of PRIMIX Corporation), 1.5 L of n-hexane ("n-HEXANE Wako 1st Grade", product of Wako Pure Chemical Industries, Ltd.) and 21 g of a methylhydrogen silicone oil ("KR-99", product of Shin-Etsu Chemical Co., Ltd.) were loaded to dissolve the methylhydrogen silicone in the n-hexane. Next, 300 g of the raw material particles were added to the n-hexane solution in the mixer. Then, the mixer contents were stirred for 30 minutes under conditions of normal temperature and a rotational speed of 30 rpm. After the stirring, the mixer contents were transferred to a 3-L separable flask equipped with a thermometer and a stirring impeller. The separable flask contents were stirred at a rotational speed of 200 rpm using a stirring device while the temperature of the separable flask contents was increased at a rate of 5° C./15 minutes from 35° C. to 70° C. Thereafter, the separable flask contents were dried using a reduced pressure dryer while being kept at a temperature of 70° C. (a reduced pressure drying process). The reduced pressure drying process was continued until the separable flask contents were fully dried to have a constant mass. The separable flask contents after the reduced pressure drying process was loaded into an electric furnace and baked for 3 hours at a temperature of 200° C. in a nitrogen atmosphere. The resultant baked substance in the form of a coarse powder was pulverized at a pulverization pressure of 0.6 MPa using the pulverzer. Through the above, the raw material particles each covered with a layer containing the silicone oil were obtained.

(Urethane Resin Covering Treatment)

A dispersion was prepared by stirring 1.5 L of ion exchanged water and 300 g of the raw material particles for 30 minutes under conditions of normal temperature and a rotational speed of 30 rpm using a mixer ("T.K. HIVIS DISPER MIX MODEL HM-3D-5", product of PRIMIX Corporation). To the resultant dispersion, 100 g of a water-soluble urethane resin ("SUPERFLEX (registered Japanese trademark) 170", product of DKS Co., Ltd., an aqueous solution having a solid concentration of 30% by mass) was added and mixing by stirring was performed thereon for 5 minutes under conditions of normal temperature and a rotational speed of 30 rpm. After the mixing, the mixer contents were transferred to a 3-L separable flask equipped with a thermometer and a stirring impeller. The separable flask contents were stirred at a rotational speed of 200 rpm using the stirring device while the temperature of the contents was increased at a rate of 5° C./15 minutes from 35° C. to 70° C. Next, the separable flask contents were stirred for 30 minutes at a rotational speed of 90 rpm while the temperature thereof was kept at 70° C. Next, the separable flask contents were cooled to the normal temperature and then filtered using a Buchner funnel. The residue in the form of a wet cake was dispersed in an ethanol aqueous solution (ethanol 50% by mass), thereby preparing a slurry. The prepared slurry was supplied to a continuous surface-modifying apparatus ("COATMIZER (registered Japanese trademark)", product of Freund Corporation) and dried, thereby obtaining a coarse powder. The drying using the continuous surface-modifying apparatus was performed under conditions of a hot-air temperature of 45° C. and a blower flow rate of 2 $m^3$/minute. The resultant coarse powder was pulverized at a pulverization pressure of 0.6 MPa using the pulverzer. Through the above, the raw material particles each covered with a layer containing the urethane resin were obtained.

(Melamine Resin Covering Treatment)

The melamine resin covering treatment was performed by the same method as the method of the urethane resin covering treatment in all aspects other than the following change. In the melamine resin covering treatment, 25 g of methylol melamine ("NIKARESIN (registered Japanese trademark) S-260", product of NIPPON CARBIDE INDUSTRIES CO., INC.) was added to the dispersion instead of the water-soluble urethane resin. Through the above, the raw material particles each covered with a layer containing a melamine resin were obtained.

(Aluminum Hydroxide Covering Treatment)

A dispersion was prepared by stirring 1.5 L of ion exchanged water and 300 g of the raw material particles for 30 minutes under conditions of the normal temperature and a rotational speed of 30 rpm using a mixer ("T.K. HIVIS DISPER MIX MODEL HM-3D-5", product of PRIMIX Corporation). The resultant dispersion was heated to 45° C. Then, 800 g of a solution containing poly-aluminum chloride ("POLY-ALUMINUM CHLORIDE" product of Takasugi Pharmaceutical Co., Ltd., concentration 80 g/L) and a 5 N aqueous solution of sodium hydroxide were simultaneously dripped into the heated dispersion. In the dripping, the dispersion was kept at 45° C. and the total dripping amount was adjusted so that the pH of the dispersion was kept at 6.0. After cooling the dispersion subjected to the dripping to 30° C., filtration was performed thereon using a Buchner funnel. The residue in the form of a wet cake was dispersed in an aqueous ethanol solution (ethanol 50% by mass), thereby preparing a slurry. The resultant slurry was supplied to a continuous surface-modifying apparatus ("COATMIZER (registered Japanese trademark)", product of Freund Corporation) and dried, thereby obtaining a coarse powder. The drying using the continuous surface-modifying apparatus was performed under conditions of a hot-air temperature of 45° C. and a blower flow rate of 2 $m^3$/minute. The resultant coarse powder was pulverized at a pulverization pressure of 0.6 MPa using the pulverzer. Through the above, the raw material particles each covered with a layer containing aluminum hydroxide were obtained.

[External Additive Particles (A-1)]

(Preparation of Bases)

Titanyl sulfate (product of YONEYAMA YAKUHIN KOGYO CO., LTD.) was added to a 4 N aqueous solution of sodium hydroxide, thereby preparing a solution having a pH of 9.0 (desulfurization treatment). Into the solution, 6 N hydrochloric acid was added for pH adjustment to 5.5. Filtration and washing were then performed thereon. After the washing, water was added to the residue in the form of a wet cake, thereby preparing a slurry. The amount of the water added was determined so that an amount when the concentration of the slurry was 1.25 mol/L in terms of $TiO_2$ conversion. To the slurry, 6 N hydrochloric acid was added for pH adjustment to 1.2 (peptization treatment). Of the slurry after the peptization treatment, 0.156 moles of the slurry in terms of $TiO_2$ conversion was added into a 3-L reaction vessel. An aqueous solution of strontium chloride was added into the reaction vessel. The reaction liquid after the addition had a molar ratio of 1.15 in terms of $SrO/TiO_2$ conversion and a concentration of 0.156 mol/L in terms of $TiO_2$ conversion. Thereafter, the reaction vessel was left to stand for 20 minutes while nitrogen gas was allowed to flow into the reaction vessel to replace the air in the reaction vessel by nitrogen gas. Next, the mixed solution in the reaction vessel was stirred and mixed at a rotational speed of 300 rpm and heated to 90° C. at a rate of 13.5° C./minute while nitrogen gas was allowed to flow into the reaction vessel. Then, 143 mL of a 2.5 N aqueous solution of sodium hydroxide was added to the mixed solution under stirring and mixing at a rotational speed of 300 rpm while the mixed solution was kept at 90° C. A time for adding the 2.5 N aqueous solution of sodium hydroxide (addition time A) was set as shown in Table 1 below. The mixed solution was stirred for 1 hour under conditions of a temperature of 90° C. and a rotational speed of 600 rpm to cause a reaction. After the reaction, the mixed solution was cooled to 40° C. and a supernatant of the mixed solution was then removed in a nitrogen atmosphere. Thereafter, a series of operation including addition of 2.5 L of pure water to a precipitate (product) contained in the mixed solution and removal of a supernatant by decantation was performed twice in the nitrogen atmosphere. After the second washing, the product was filtered using a Buchner funnel and the residue in the form of a wet cake was dried for 8 hours in the air at a temperature of 110° C. Through the above, bases (strontium titanate particles) were obtained.

The above-described conductive layer formation process was performed on the resultant bases. Then, the above-described titanate coupling agent providing treatment (first treatment) was performed on the resultant particles as the raw material particles each having the base and the conductive layer. Through the treatment, the external additive particles (A-1) each including the base, the conductive layer, and the layer containing the component derived from the titanate coupling agent were obtained.

[External Additive Particles (A-2) to (A-29) and (a-1) to (a-5)]

The external additive particles of each of types (A-2) to (A-29) and (a-1) to (a-5) were prepared by the same preparation method as that of the external additive particles (A-1) in all aspects other than the following changes.

In preparation of each type of the external additive particles (A-2) to (A-29) and (a-1) to (a-5), the addition time A in the preparation of the bases and the respective amounts of $SnCl_4.5H_2O$ and $SbCl_3$ in the conductive layer formation process were changed to those shown in Table 1 below. The following describes further changes for preparation of the respective types of external additive particles (A-10) to (A-15), (A-18), (A-19), (A-28), (A-29), and (a-1) to (a-5).

In the preparation of the external additive particles (A-10), the silane coupling agent providing treatment was performed as the first treatment on the particles each including the base and the conductive layer.

In the preparation of the external additive particles (A-11), the silicon oil providing treatment was performed as the first treatment on the particles each including the base and the conductive layer.

In the preparation of each type of the external additive particles (A-12), (A-18), (A-19), (A-28), and (A-29), the titanate coupling agent providing treatment (first treatment) and then the silane coupling agent providing treatment (second treatment) were performed on the particles each including the base and the conductive layer.

In the preparation of the external additive particles (A-13), the melamine resin covering treatment (first treatment) and then the silane coupling agent providing treatment (second treatment) were performed on the particles each including the base and the conductive layer.

In the preparation of the external additive particles (A-14), the urethane resin covering treatment (first treatment) and then the silane coupling agent providing treatment (second treatment) were performed on the particles each including the base and the conductive layer.

In preparation of the external additive particles (A-15), the aluminum hydroxide covering treatment (first treatment) and then the silane coupling agent providing treatment (second treatment) were performed on the particles each including the base and the conductive layer.

In the preparation of the external additive particles (a-1), the melamine resin covering treatment (first treatment) was performed on the particles each including the base and the conductive layer.

In the preparation of the external additive particles (a-2), the urethane resin covering treatment (first treatment) was performed on the particles each including the base and the conductive layer.

In the preparation of the external additive particles (a-3), the aluminum hydroxide covering treatment (first treatment) was performed on the particles each including the base and the conductive layer.

In the preparation of the external additive particles (a-4), the particles each including the base and the conductive layer were used directly as external additive particles.

In the preparation of the external additive particles (a-5), the titanate coupling agent providing treatment (first treatment) was performed on the bases (strontium titanate particles).

[External Additive Particles (a-6) and (a-7)]

A mixture of oxygen gas and titanium tetrachloride obtained by chlorine method was introduced into a gas-phase oxidation reactor, and caused to react in a gaseous phase at a temperature of 1,000° C., thereby obtaining bulky titanium oxide. The bulky titanium oxide was crashed using a hammer mill, and the resultant crashed substance was washed and then dried at 110° C. The crashed product after the drying was deaggregated using a supersonic jet pulverizer ("JET MILL IDS-2", product of Nippon Pneumatic Mfg. Co., Ltd.), thereby obtaining titanium oxide particles (number average primary particle diameter: 90 nm, crystal form: rutile type). Note that the number average primary particle diameter of the titanium oxide particles was adjusted by appropriate setting of the hammer mill.

The conductive layer formation process was performed on the resultant titanium oxide particles. Through the above, the external additive particles (a-7) each including the base (titanium oxide particle) and the conductive layer covering the base were obtained.

Furthermore, the titanate coupling agent providing treatment (first treatment) was performed on the external additive particles (a-7) as the raw material particles. Through the treatment, the external additive particles (a-6) each including the base (titanate oxide particle), the conductive layer covering the base, and a layer covering the conductive layer and containing the component derived from the titanate coupling agent were obtained.

Preparation methods of the respective types of external additive particles are shown in Table 1 below. In Table 1 below. "–" represents corresponding treatment not having been performed. "TTS" represents "PLENACT (registered Japanese trademark) TTS" produced by Ajinomoto Co., Inc. Also, "iBTES" represents isobutyltriethoxysilane. "PAC" represents poly-aluminum chloride.

TABLE 1

| External additive particles | Base preparation Type | Addition time A [h] | Conductive layer formation $SnCl_4 \cdot 5H_2O$ [g] | $SbCl_3$ [g] | First treatment Type | Amount [g] | Second treatment Type | Amount [g] |
|---|---|---|---|---|---|---|---|---|
| A-1 | $SrTiO_3$ | 12 | 409 | 72 | TTS | 24 | — | — |
| A-2 | $SrTiO_3$ | 12 | 777 | 137 | TTS | 24 | — | — |
| A-3 | $SrTiO_3$ | 12 | 818 | 144 | TTS | 24 | — | — |
| A-4 | $SrTiO_3$ | 12 | 1309 | 231 | TTS | 24 | — | — |
| A-5 | $SrTiO_3$ | 12 | 695 | 65 | TTS | 24 | — | — |
| A-6 | $SrTiO_3$ | 12 | 695 | 164 | TTS | 24 | — | — |
| A-7 | $SrTiO_3$ | 12 | 1023 | 66 | TTS | 24 | — | — |
| A-8 | $SrTiO_3$ | 12 | 1023 | 271 | TTS | 24 | — | — |
| A-9 | $SrTiO_3$ | 12 | 614 | 108 | TTS | 24 | — | — |
| A-10 | $SrTiO_3$ | 12 | 614 | 108 | iBTES | 26 | — | — |
| A-11 | $SrTiO_3$ | 12 | 595 | 105 | Silicone oil | 21 | — | — |

TABLE 1-continued

| External additive particles | Base preparation Type | Addition time A [h] | Conductive layer formation $SnCl_4 \cdot 5H_2O$ [g] | $SbCl_3$ [g] | First treatment Type | Amount [g] | Second treatment Type | Amount [g] |
|---|---|---|---|---|---|---|---|---|
| A-12 | $SrTiO_3$ | 12 | 614 | 108 | TTS | 24 | iBTES | 26 |
| A-13 | $SrTiO_3$ | 12 | 614 | 108 | Melamine resin | 25 | iBTES | 26 |
| A-14 | $SrTiO_3$ | 12 | 614 | 108 | Urethane resin | 100 | iBTES | 26 |
| A-15 | $SrTiO_3$ | 12 | 614 | 108 | PAC | 64 | iBTES | 26 |
| A-16 | $SrTiO_3$ | 3 | 614 | 108 | TTS | 24 | — | — |
| A-17 | $SrTiO_3$ | 50 | 614 | 108 | TTS | 24 | — | — |
| A-18 | $SrTiO_3$ | 3 | 614 | 108 | TTS | 24 | iBTES | 26 |
| A-19 | $SrTiO_3$ | 50 | 614 | 108 | TTS | 24 | iBTES | 26 |
| A-20 | $SrTiO_3$ | 12 | 368 | 65 | TTS | 24 | — | — |
| A-21 | $SrTiO_3$ | 12 | 1350 | 238 | TTS | 24 | — | — |
| A-22 | $SrTiO_3$ | 12 | 695 | 61 | TTS | 24 | — | — |
| A-23 | $SrTiO_3$ | 12 | 695 | 168 | TTS | 24 | — | — |
| A-24 | $SrTiO_3$ | 12 | 1023 | 60 | TTS | 24 | — | — |
| A-25 | $SrTiO_3$ | 12 | 1023 | 283 | TTS | 24 | — | — |
| A-26 | $SrTiO_3$ | 2 | 614 | 108 | TTS | 24 | — | — |
| A-27 | $SrTiO_3$ | 52 | 614 | 108 | TTS | 24 | — | — |
| A-28 | $SrTiO_3$ | 2 | 614 | 108 | TTS | 24 | iBTES | 26 |
| A-29 | $SrTiO_3$ | 52 | 614 | 108 | TTS | 24 | iBTES | 26 |
| a-1 | $SrTiO_3$ | 12 | 614 | 108 | Melamine resin | 25 | — | — |
| a-2 | $SrTiO_3$ | 12 | 614 | 108 | Urethane resin | 100 | — | — |
| a-3 | $SrTiO_3$ | 12 | 614 | 108 | PAC | 64 | — | — |
| a-4 | $SrTiO_3$ | 12 | 614 | 108 | — | — | — | — |
| a-5 | $SrTiO_3$ | 12 | — | — | TTS | 24 | — | — |
| a-6 | $TiO_2$ | — | 614 | 108 | TTS | 24 | — | — |
| a-7 | $TiO_2$ | — | 614 | 108 | — | — | — | — |

<Production of Two-Component Developer>

A toner was obtained by mixing 1 part by mass of an external additive (one type of the external additive particles (A-1) to (A-29) and (a-1) to (a-7)), 2 parts by mass of silica particles, and 100 parts by mass of toner mother particles using a multi-purpose compact mixing and pulverizing apparatus ("MULTIPURPOSE MIXER", product of Nippon Coke & Engineering Co., Ltd.). Next, 10 parts by mass of the toner and 100 parts by mass of a carrier were mixed for 30 minutes using a ball mill. Through the above two-component developers of Examples 1 to 29 and Comparative Examples 1 to 7 were produced.

In production of each two-component developer, the silica particles used were "AEROSIL (registered Japanese trademark) REA90" produced by Nippon Aerosil Co., Ltd. The toner mother particles used were particles obtained by removing any external additive from a cyan toner for use in "TASKalfa (registered Japanese trademark) 5550ci" produced by KYOCERA Document Solutions Inc. The carrier used was a carrier for use in "TASKalfa (registered Japanese trademark) 5550ci" produced by KYOCERA Document Solutions Inc.

[Analysis of External Additive Particles]

With respect to the external additive particles in each of the two-component developers of Examples 1 to 29 and Comparative Examples 1 to 7, a "ratio of a mass of tin oxide ($SnO_2$) to a mass of the bases" and a "ratio of an amount of substance of antimony atoms to a total amount of substance of tin atoms and the antimony atoms in the conductive layers" were measured by fluorescent X-ray analysis. With respect to each type of the external additive particles, a particle diameter, an amount of separated tin, and a powder resistivity were measured. The measurement results are shown in Table 2 below.

(Fluorescent X-Ray Analysis)

The external additive particles of each type were analyzed using fluorescent X-rays, and the "ratio ($SnO_2$/bases) of a mass of tin oxide to a mass of the bases" and the "ratio (Sb/(Sn+Sb)) of an amount of substance of antimony atoms to a total amount of substance of tin atoms and the antimony atoms in the conductive layers" were calculated. Conditions for the fluorescent X-ray analysis were as follows. Note that calibration curves in measurement of the external additive particles of the types (A-1) to (A-29) and (a-1) to (a-5) were plotted using plural types of samples for calibration curve plotting obtained by mixing strontium titanate, tin oxide ($SnO_2$), and antimony pentoxide at respective specific blend ratios. Also, calibration curves in measurement of the external additive particles of the types (a-6) and (a-7) were plotted using plural types of samples for calibration curve plotting obtained by mixing titanium oxide, tin oxide ($SnO_2$), and antimony pentoxide at respective specific blend ratios.

(Conditions for Fluorescent X-Ray Analysis)

Sample: A columnar pellet of external additive particles press-molded under conditions of a pressure of 20 MPa and a pressure time of 3 seconds.

Analyzer: Scanning fluorescent X-ray analyzer ("ZSX", product of Rigaku Corporation).

X-ray tube (X-ray source): Rh (rhodium).

Excitation conditions: Tube voltage of 50 kV and tube current of 50 mA.

Measurement range (X-ray irradiation range): 30 mm in diameter.

Measured elements: Strontium, antimony, titanium, and tin.

(Particle Diameter Measurement)

A cross-sectional image (magnification: 30,000K) of each toner included in the developers was captured using a scanning electron microscope ("JSM-6700F", product of JEOL Ltd). Equivalent circle diameters of 100 external additive particles (specifically, one type of the external additive particles (A-1) to (A-29) and (a-1) to (a-7)) in the captured cross-sectional image were analyzed using image analysis software ("WinROOF", product of MITANI CORPORATION), and an average value thereof was taken to be a number average primary particle diameter.

(Amount of Separated Tin)

A 500-mL glass bottle was charged with 5 g of external additive particles (specifically, one type of the external additive particles (A-1) to (A-29) and (a-1) to (a-7)) and 25 g of ethanol, and shaken by hand until sediment was dispersed. Ultrasonic treatment (120 W, 38 kHz) was performed on the resultant mixture for 1 minute using an ultrasonic cleaner ("US-2KS", product of SND Co., Ltd.). Thereafter, 10 g of ethanol was further added to the mixture and the resultant mixture was shaken again by hand until sediment was dispersed. Then, ultrasonic treatment (100 W, 28 kHz) was performed on the mixture for 5 minutes using an ultrasonic plastic welder ("UPW0128A1H", product of Ultrasonic Engineering Co., Ltd.). Subsequently, the mixture was transferred to a 5-mL centrifugal tube and subjected to centrifugation (8,000 rpm, 1 minute). After the centrifugation, a supernatant was collected. Then, 1,000 μL of the supernatant was added onto a filter-like "Sample plate 20 millimeters (3399O053)" of a trace powder container for X-ray measurement (product of Rigaku Corporation) using a pipette, and was then dried. Thereafter, a strength of Sn (amount [kcps/mL] of separated tin) adsorbed to the trace powder container was measured using a fluorescent X-ray analyzer. Conditions for the fluorescent X-ray analysis were the same as the conditions for the above-described fluorescent X-ray analysis for the external additive particles. A toner including external additive particles having a large amount of separated tin (that is, external additive particles including conductive layers having a tendency to readily peel off) tends to readily vary in charge stability due to adhesion of peeled conductive layers to the carrier and the like.

(Powder Resistivity)

Into a cylindrical measurement cell of an electric resistance meter ("R6561", product of ADVANTEST CORPORATION), 5 g of external additive particles (specifically, one type of the external additive particles (A-1) to (A-29) and (a-1) to (a-7)) were loaded. The measurement cell included a fluororesin-made cylindrical portion and a metal electrode serving as a bottom surface thereof. Subsequently, an additional electrode of the electric resistance meter was connected to the external additive particles loaded in the measurement cell. To the additional electrode, 1 kg of a load was applied. Subsequently, 10 V of DC voltage was applied across these electrodes and an electric resistance of the external additive particles was measured after 1 minute from a start of the voltage application. Note that the 1-kg load application to the additional electrode was continued from a start of the voltage application to an end of the measurement. The measurement was carried out in an environment at a temperature of 25° C. and a relative humidity of 50%. The powder resistivity (volume resistivity) of the external additive particles was calculated using the following equation based on a value of the measured electric resistance and a dimension of the external additive particles (specifically, the external additive particles loaded in the measurement cell) at the electric resistance measurement.

(Powder resistivity [Ω·cm])=(value of electric resistance)×(sectional area of current path)/(length of current path)

Table 2 below shows layer structure of each type of external additive particles in addition. In Table 2 below, where the external additive particles each include one layer outside the conductive layer, the one layer is taken to be a "surface treatment laver". Also in Table 2 below, where the external additive particles each include two layers outside the conductive laver, an inner layer of the two layers is taken to be a protective layer" and an outer layer thereof is taken to be a "surface treatment layer". In Table 2 below, "Particle diameter" represents a number average primary particle diameter.

TABLE 2

| | External additive particles | Conductive layer $SnO_2$/base | Conductive layer Sb/(Sn + Sb) | Protective layer | Surface treatment layer | Particle diameter [nm] | Amount of separated tin [kcps/mL] | Powder resistivity [Ω · cm] |
|---|---|---|---|---|---|---|---|---|
| Example 1 | A-1 | 0.59 | 0.21 | — | TTS | 92 | 0.36 | 38 |
| Example 2 | A-2 | 1.11 | 0.21 | — | TTS | 87 | 1.78 | 5 |
| Example 3 | A-3 | 1.17 | 0.21 | — | TTS | 90 | 2.02 | 5 |
| Example 4 | A-4 | 1.88 | 0.22 | — | TTS | 90 | 5.89 | 1 |
| Example 5 | A-5 | 1.00 | 0.13 | — | TTS | 91 | 1.74 | 43 |
| Example 6 | A-6 | 1.00 | 0.26 | — | TTS | 93 | 1.31 | 39 |
| Example 7 | A-7 | 1.47 | 0.09 | — | TTS | 86 | 5.52 | 35 |
| Example 8 | A-8 | 1.47 | 0.29 | — | TTS | 92 | 3.22 | 33 |
| Example 9 | A-9 | 0.88 | 0.21 | — | TTS | 87 | 1.00 | 13 |
| Example 10 | A-10 | 0.88 | 0.21 | — | iBTMS | 93 | 2.01 | 12 |
| Example 11 | A-11 | 0.88 | 0.21 | — | Silicone oil | 87 | 2.04 | 12 |
| Example 12 | A-12 | 0.88 | 0.21 | TTS | iBTMS | 90 | 0.88 | 12 |
| Example 13 | A-13 | 0.88 | 0.21 | Melamine | iBTMS | 89 | 0.88 | 11 |
| Example 14 | A-14 | 0.88 | 0.21 | Urethane | iBTMS | 89 | 1.32 | 11 |
| Example 15 | A-15 | 0.88 | 0.21 | Alumina | iBTMS | 91 | 0.79 | 13 |
| Example 16 | A-16 | 0.88 | 0.21 | — | TTS | 62 | 0.99 | 12 |
| Example 17 | A-17 | 0.88 | 0.21 | — | TTS | 297 | 1.00 | 12 |
| Example 18 | A-18 | 0.88 | 0.21 | TTS | iBTMS | 61 | 0.88 | 12 |
| Example 19 | A-19 | 0.88 | 0.21 | TTS | iBTMS | 300 | 0.88 | 13 |
| Example 20 | A-20 | 0.53 | 0.21 | — | TTS | 86 | 0.28 | 48 |
| Example 21 | A-21 | 1.93 | 0.22 | — | TTS | 91 | 6.29 | 2 |
| Example 22 | A-22 | 1.00 | 0.12 | — | TTS | 87 | 1.77 | 51 |
| Example 23 | A-23 | 1.00 | 0.27 | — | TTS | 93 | 1.29 | 58 |
| Example 24 | A-24 | 1.47 | 0.08 | — | TTS | 94 | 6.08 | 49 |
| Example 25 | A-25 | 1.47 | 0.30 | — | TTS | 94 | 3.22 | 85 |
| Example 26 | A-26 | 0.88 | 0.21 | — | TTS | 36 | 0.99 | 12 |
| Example 27 | A-27 | 0.88 | 0.21 | — | TTS | 306 | 0.99 | 11 |

TABLE 2-continued

| | External additive particles | Conductive layer $SnO_2$/base | Conductive layer Sb/(Sn + Sb) | Conductive layer Protective layer | Surface treatment layer | Particle diameter [nm] | Amount of separated tin [kcps/mL] | Powder resistivity [Ω · cm] |
|---|---|---|---|---|---|---|---|---|
| Example 28 | A-28 | 0.88 | 0.21 | TTS | iBTMS | 36 | 0.88 | 13 |
| Example 29 | A-29 | 0.88 | 0.21 | TTS | iBTMS | 313 | 0.89 | 12 |
| Comparative Example 1 | a-1 | 0.88 | 0.21 | — | Melamine | 87 | 0.98 | 13 |
| Comparative Example 2 | a-2 | 0.88 | 0.21 | — | Urethane | 90 | 1.41 | 12 |
| Comparative Example 3 | a-3 | 0.88 | 0.22 | — | Alumina | 86 | 0.87 | 12 |
| Comparative Example 4 | a-4 | 0.88 | 0.22 | — | — | 88 | 11.28 | 1 |
| Comparative Example 5 | a-5 | — | — | — | TTS | 91 | 0.00 | $4.7 \times 10^7$ |
| Comparative Example 6 | a-6 | 0.88 | 0.21 | — | TTS | 97 | 0.34 | 14 |
| Comparative Example 7 | a-7 | 0.88 | 0.22 | — | — | 93 | 6.35 | 1 |

<Evaluation>

Evaluation of each of image density stability, a photosensitive member pinhole, filming resistance, and anti-fogging property was carried out for each of the two-component developers of Examples 1 to 29 and Comparative Examples 1 to 7 by the following methods. The evaluation results are shown in Table 3 below.

[Evaluation Apparatus]

A color multifunction peripheral ("TASKalfa (registered Japanese trademark) 5550ci", product of KYOCERA Document Solutions Inc.) was used as an evaluation apparatus. A two-component developer (specifically, a two-component developer including any one type of the external additive particles (A-1) to (A-29) and (a-1) to (a-7)) was loaded into a cyan-color development device of the evaluation apparatus. Further, a toner for replenishment use (specifically, the same toner as a toner included in the two-component developer) was loaded into a cyan-color toner container of the evaluation apparatus. Then, the evaluation apparatus was left to stand for 24 hours in an environment at a temperature of 32.5° C. and a relative humidity of 80% (in an HH environment).

[Image Density Stability]

An image pattern at a printing rate of 5% including a solid image was printed on 1,000 sheets of printing paper in the HH environment using the evaluation apparatus having left to stand in the HH environment. A reflection density of the solid image was measured for every tenth sheet of the resultant 1,000 sheets of printed paper. The reflection density was measured using a reflectance densitometer ("RD914", product of X-Rite Inc.). A minimum value of the measured reflection densities was used as an evaluation value (ID). The image density stability was evaluated in accordance with the following criteria.

(Evaluation Criteria of Image Density Stability)

A (very good): ID of at least 1.3.

B (good): ID of at least 1.1 and less than 1.3.

C (poor): ID of less than 1.1.

[Filming Resistance and Photosensitive Member Pinhole]

An image pattern at a printing rate of 5% was printed on 150,000 sheets of printing paper in an environment at a temperature of 24° C. and a relative humidity of 60% using the evaluation apparatus after the evaluation of image density. Every 5,000th sheet of the resultant 150,000 sheets of printed paper was observed with naked eyes to determine the presence or absence of an image defect (dash mark) resulting from filming and the presence or absence of an image defect resulting from a photosensitive member pinhole. Filming resistance and a photosensitive member pinhole were evaluated in accordance with the following criteria.

(Filming Resistance)

A (very good): No image defects resulting from filming were observed even in the 150,000th sheet of printed paper.

B (good): An image defect resulting from filming was not observed in the 100,000th sheet of printed paper but was observed in the 150,000th sheet of printed paper.

C (poor): An image defect resulting from filming was observed in the 100,000th sheet of printed paper.

(Photosensitive Member Pinhole)

A (very good): No image defects resulting from a photosensitive member pinhole were observed even in 150,000th sheet of printed paper.

B (good): An image defect resulting from a photosensitive member pinhole was not observed in the 100,000th sheet of printed paper but was observed in the 150,000th sheet of printed paper.

C (poor): An image defects resulting from a photosensitive member pinhole was observed in the 100,000th sheet of printed paper.

[Anti-Fogging Property]

An image pattern at a printing rate of 0.5% was printed on 1,000 sheets of printing paper in an environment at a temperature of 24° C. and a relative humidity of 60% using the evaluation apparatus after each evaluation of filming resistance and a photosensitive member pinhole. Then, an image pattern at a printing rate of 80% was printed on 100 sheets of printing paper. Thereafter, a reflection density X of a non-printed portion (blank portion) of each of the 100 sheets of printed paper as a result of the printing at a printing rate of 80% was measured using a reflectance densitometer ("RD918", product of X-Rite Inc.). In addition, a reflection density Y of a sheet of printing paper undergoing no printing was measured using the reflectance densitometer ("RD918", product of X-Rite Inc.). For each of the 100 sheets of printed paper (printing rate 80%), an expression "(reflection density X)−(reflection density Y)" was used for value calculation. Then, a maximum value thereof was used as an evaluation value (FD) for fogging density. Anti-fogging property was evaluated in accordance with the following criteria.

(Evaluation Criteria of Anti-Fogging Property)

A (most favorable): FD of no greater than 0.0005.

B (very good): FD of greater than 0.0005 and no greater than 0.010.

C (good): FD of greater than 0.010 and no greater than 0.015.

D (poor): ED of greater than 0.015.

TABLE 3

| | External additive | Anti-fogging property | | Photosensitive member | Image density stability | | Filming |
|---|---|---|---|---|---|---|---|
| | particles | FD | Evaluation | pinhole | ID | Evaluation | resistance |
| Example 1 | A-1 | 0.001 | A | A | 1.18 | B | A |
| Example 2 | A-2 | 0.005 | A | A | 1.17 | B | A |
| Example 3 | A-3 | 0.006 | B | A | 1.16 | B | A |
| Example 4 | A-4 | 0.010 | B | A | 1.16 | B | A |
| Example 5 | A-5 | 0.004 | A | A | 1.17 | B | A |
| Example 6 | A-6 | 0.004 | A | A | 1.17 | B | A |
| Example 7 | A-7 | 0.010 | B | A | 1.17 | B | A |
| Example 8 | A-8 | 0.007 | B | A | 1.19 | B | A |
| Example 9 | A-9 | 0.003 | A | A | 1.14 | B | A |
| Example 10 | A-10 | 0.007 | B | A | 1.38 | A | A |
| Example 11 | A-11 | 0.006 | B | A | 1.32 | A | A |
| Example 12 | A-12 | 0.003 | A | A | 1.37 | A | A |
| Example 13 | A-13 | 0.002 | A | A | 1.38 | A | A |
| Example 14 | A-14 | 0.004 | A | A | 1.39 | A | A |
| Example 15 | A-15 | 0.002 | A | A | 1.35 | A | A |
| Example 16 | A-16 | 0.003 | A | A | 1.22 | B | A |
| Example 17 | A-17 | 0.003 | A | A | 1.22 | B | A |
| Example 18 | A-18 | 0.003 | A | A | 1.36 | A | A |
| Example 19 | A-19 | 0.003 | A | A | 1.39 | A | A |
| Example 20 | A-20 | 0.001 | A | B | 1.17 | B | A |
| Example 21 | A-21 | 0.011 | C | A | 1.19 | B | A |
| Example 22 | A-22 | 0.005 | A | B | 1.18 | B | A |
| Example 23 | A-23 | 0.004 | A | B | 1.16 | B | A |
| Example 24 | A-24 | 0.012 | C | B | 1.18 | B | A |
| Example 25 | A-25 | 0.007 | B | B | 1.19 | B | A |
| Example 26 | A-26 | 0.003 | A | A | 1.17 | B | B |
| Example 27 | A-27 | 0.003 | A | A | 1.16 | B | B |
| Example 28 | A-28 | 0.003 | A | A | 1.35 | A | B |
| Example 29 | A-29 | 0.003 | A | A | 1.38 | A | B |
| Comparative Example 1 | a-1 | 0.003 | A | A | 1.05 | C | A |
| Comparative Example 2 | a-2 | 0.004 | A | A | 1.09 | C | A |
| Comparative Example 3 | a-3 | 0.002 | A | A | 0.98 | C | A |
| Comparative Example 4 | a-4 | 0.028 | D | A | 0.96 | C | A |
| Comparative Example 5 | a-5 | 0.003 | A | D | 1.19 | B | A |
| Comparative Example 6 | a-6 | 0.022 | D | A | 1.19 | B | A |
| Comparative Example 7 | a-7 | 0.024 | D | A | 1.02 | C | A |

Each of the two-component developers of Examples 1 to 29 was a two-component developer including a toner including toner particles and a carrier including carrier particles. The toner particles each included a toner mother particle and an external additive attached to a surface of the toner mother particle. The external additive included external additive particles. The external additive particles each included a base containing strontium titanate, a conductive layer covering the base, and a surface treatment layer either directly or indirectly covering the conductive layer. The surface treatment layer contained a component derived from a hydrophobizing agent. As shown in Table 3, the two-component developers of Examples 1 to 29 each could inhibit a photosensitive member pinhole. The two-component developers of Examples 1 to 29 each were excellent in both anti-fogging property and image density stability.

In particular, the external additive particles of each of the two-component developers of Examples 1 to 25 had a number average primary particle diameter of at least 60 nm and no greater than 300 nm. Therefore, filming resistance of each of the two-component developers of Examples 1 to 25 was evaluated as very good.

By contrast, none of the two-component developers of Comparative Examples 1 to 7 had the above features. Therefore, at least one of anti-fogging property, a photosensitive member pinhole, and image density stability was evaluated as poor for the two-component developers of Comparative Examples 1 to 7.

Specifically, the external additive particles of the types (a-1) to (a-3) respectively used for the two-component developers of Comparative Examples 1 to 3 had no layer containing a component derived from a hydrophobizing agent as a surface treatment layer, and therefore, were determined to have insufficient charge stability, thereby leading to decreased image density.

The external additive particles (a-4) used in the two-component developer of Comparative Example 4 had no surface treatment layers, and therefore, were determined to have insufficient charge stability, thereby leading to decreased image density.

The external additive particles (a-5) used in the two-component developer of Comparative Example 5 had no conductive layers, and therefore, it was determined that excessive charge accumulation could not be suppressed, thereby leading to production of a photosensitive member pinhole caused due to the presence of residual toner.

The external additive particles of the types (a-6) and (a-7) respectively used in the two-component developer of Comparative Examples 6 and 7 had no bases containing strontium titanate, and therefore, were determined to have insufficient charge stability, leading to occurrence of fogging.

What is claimed is:

1. A two-component developer comprising a toner including toner particles and a carrier including carrier particles, wherein the toner particles each include a toner mother particle and an external additive attached to a surface of the toner mother particle, the external additive includes external additive particles, the external additive particles each include a base containing strontium titanate, a conductive layer covering the base, and a surface treatment layer indirectly covering the conductive layer, the surface treatment layer contains a component derived from a hydrophobizing agent, the external additive particles each further include a protective layer disposed between the conductive layer and the surface treatment layer, the protective layer contains a nitrogen-containing resin, aluminum hydroxide, or a component derived from a titanate coupling agent, and the surface treatment layer contains a silicone oil or a component derived from a silane coupling agent.

2. The two-component developer according to claim 1, wherein the conductive layer contains antimony-doped tin oxide.

3. The two-component developer according to claim 2, wherein in the external additive particles, a ratio of a mass of tin oxide ($SnO_2$) to a mass of the base is at least 0.55 and no greater than 1.90.

4. The two-component developer according to claim 2, wherein a molar ratio of antimony atoms to a total of tin atoms and the antimony atoms in the conductive layers is at least 0.09 and no greater than 0.29.

5. The two-component developer according to claim 1, wherein the external additive particles have a number average primary particle diameter of at least 60 nm and no greater than 300 nm.

* * * * *